US006986264B1

(12) United States Patent
Taras et al.

(10) Patent No.: US 6,986,264 B1
(45) Date of Patent: Jan. 17, 2006

(54) ECONOMIZED DEHUMIDIFICATION SYSTEM

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/891,581

(22) Filed: Jul. 15, 2004

(51) Int. Cl.
*F25B 41/00* (2006.01)

(52) U.S. Cl. ..... 62/513; 62/90; 62/238.6

(58) Field of Classification Search ..... 62/513, 62/90, 93, 95, 173, 176.1, 238.6
See application file for complete search history.

(56) References Cited

U.S. PATENT DOCUMENTS 3,264,840 A * 8/1966 Harnish ..... 62/173
5,651,285 A * 7/1997 Legras ..... 73/290 V
6,250,258 B1 * 6/2001 Liebig ..... 122/406.5
6,701,723 B1 3/2004 Dobmeier

* cited by examiner

*Primary Examiner*—Melvin Jones
(74) *Attorney, Agent, or Firm*—Carlson, Gaskey & Olds

(57) ABSTRACT

Various refrigerant system schematics incorporate the ability to bypass refrigerant around a condenser, to selectively provide refrigerant of a desired thermodynamic state to downstream system components, including a reheat coil located downstream of the condenser. In addition, the reheat coil may be utilized in combination, or independently from an economizer cycle, that is also incorporated into the system design. The economizer branch can be configured in a sequential or parallel arrangement relative to the reheat coil. Consequently, a wide spectrum of sensible and latent load demands can be satisfied. Furthermore, various schematics provide distinct benefits and flexibility in unloading and temperature and humidity control, also resulting in system performance and reliability enhancement.

20 Claims, 3 Drawing Sheets

ECONOMIZED DEHUMIDIFICATION SYSTEM

BACKGROUND OF THE INVENTION

This application relates to refrigerant systems that incorporate both an economizer cycle and a reheat coil in several unique configurations to provide better dehumidification performance as well as temperature and humidity control.

Refrigerant systems are utilized to control the temperature and humidity of air in various environments. In a typical refrigerant system, a refrigerant is compressed in a compressor and delivered to a condenser. In the condenser, heat is exchanged between outside ambient air and the refrigerant. From the condenser, the refrigerant passes to an expansion device, at which the refrigerant is expanded to a lower pressure and temperature, and then to an evaporator. In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

In some cases, the temperature level, to which the air is brought to provide a comfort environment in a conditioned space, may need to be higher than the temperature that would provide the ideal humidity level. This has presented design challenges to refrigerant system designers. One way to address such challenges is to utilize various schematics incorporating reheat coils. In many cases, the reheat coils, placed on the way of indoor air stream behind the evaporator, are employed for the purpose of reheating the air supplied to the conditioned space after it has been overcooled in the evaporator, where the moisture has been removed.

One of the options available to a refrigerant system designer to increase efficiency is a so-called economizer cycle. In the economizer cycle, a portion of the refrigerant flowing from the condenser is tapped and passed through an economizer expansion device and then to an economizer heat exchanger. This tapped refrigerant subcools a main refrigerant flow that also passes through the economizer heat exchanger. The tapped refrigerant leaves the economizer heat exchanger, usually in a vapor state, and is injected back into the compressor at an intermediate compression point (or in between the compressor stages, in case multi-stage compression is utilized). The main refrigerant is additionally subcooled after passing through the economizer heat exchanger. The main refrigerant then passes through a main expansion device and an evaporator. This main flow will have a higher cooling capacity due to additional subcooling obtained in the economizer heat exchanger. An economizer cycle thus provides enhanced system performance. In an alternate arrangement, a portion of the refrigerant is tapped and passed through the economizer expansion device after being passed through the economizer heat exchanger (along with the main flow). In all other aspects this arrangement is identical to the configuration described above.

As mentioned above, another option available to a refrigerant system designer is to include a reheat coil into the system schematics. As known, at least a portion of the refrigerant upstream of the expansion device is passed through a reheat heat exchanger and then is returned back to the main circuit. At least a portion of a conditioned air, having passed over the evaporator for the moisture removal and humidity control, is then passed over this reheat heat exchanger to be reheated to a desired temperature.

Recently, the assignee of this application has developed a system that combines the reheat coil and economizer cycle. However, variations of this basic concept have yet to be fully developed.

SUMMARY OF THE INVENTION

In disclosed schematics, a bypass is provided around the condenser, and a tap to lead a refrigerant to a reheat coil is positioned downstream of where the bypass taps refrigerant from the main refrigerant circuit and downstream of the condenser. In this manner, a control can utilize the bypass to achieve a particular thermodynamic state of refrigerant to the reheat coil. Thus, superior control over humidity and temperature is provided.

In various embodiments, an economizer cycle is also incorporated into the system design, with the economizer cycle being either in a sequential arrangement with the reheat coil (upstream or downstream of the reheat coil tap) or in a parallel configuration. The economizer cycle and the reheat coil can be selectively operated in conjunction or independently from each other to satisfy a wide spectrum of external sensible and latent capacity demands as well as enhance system performance characteristics.

These and other features of the present invention can be best understood from the following specification and drawings, the following of which is a brief description.

DETAILED DESCRIPTION OF THE PREFERRED EMBODIMENT

Figure 1A:
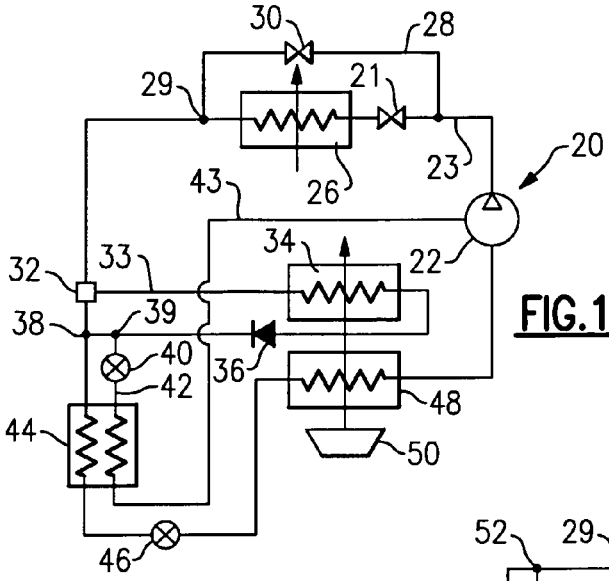
FIG. 1A is a first schematic of a refrigerant system according to this invention.

A refrigerant system 20 is illustrated in FIG. 1A. A compressor 22 compresses a refrigerant and delivers a compressed refrigerant into a main refrigerant line 23. A condenser 26 is positioned downstream of the compressor 22. A bypass line 28 bypasses from the main refrigerant line 23 and around the condenser 26, returning refrigerant to the main refrigerant line 23 at a point 29. As shown, a flow control device 30 is positioned on the bypass line 28. A control for the refrigerant cycle 20 may operate the flow control device 30 (through modulation or pulsation techniques) to bypass either a portion or all of the refrigerant around the condenser 26, for a purpose to be disclosed below. In case it is desired to bypass the entire refrigerant amount around the condenser, a flow control device 21 upstream of the condenser 26 has to be closed and the flow control device 30 must be open.

A three-way valve 32 communicates with the main refrigerant line 23 and selectively taps refrigerant into a line 33 from the main refrigerant line 23, and through a reheat coil 34. Downstream of the reheat coil 34, refrigerant passes through a check valve 36, and at a point 38 is returned to the main refrigerant line 23.

As also shown, an economizer cycle includes a tap at point 39 from the return line for the reheat coil 34. Tap 39 communicates refrigerant into a tap line 42, through an economizer expansion device 40. The main refrigerant line 23 passes through an economizer heat exchanger 44, as does the tap line 42. While the two flows are shown going in the same direction through the economizer heat exchanger 44, in practice, it may be preferable to have the two streams flowing in the counter-flow arrangement, however, for ease of illustration purposes, the refrigerants are shown flowing in the same direction. A line 43 returns refrigerant, preferably in the vapor state, from tap line 22 downstream of economizer heat exchanger 44 to the compressor 22 at an intermediate compression point. In some modes of operation, it is desirable to shutoff the economizer circuit, and if the auxiliary expansion device 38 is not capable to perform such a function, then addition shutoff valve may be added to the economizer loop.

A main expansion device 46 is positioned on the main refrigerant line 23, downstream of the economizer heat exchanger 44. Downstream of the main expansion device 46 is an evaporator 48. As is known, an air moving device, such as a fan 50, passes air over the evaporator 48, and at least a portion of that air flows over the reheat coil 34.

As known, refrigerant is passed to the reheat coil 34 at a temperature warmer than the temperature of refrigerant in the evaporator 48. In some cases, air passing over the evaporator 48 can be cooled below a temperature desirable by an occupant of the environment to be conditioned by the refrigerant system 20, and such that a significant amount of moisture can be removed from the air. That dehumidified air is then passed over the reheat coil 34, where its temperature is increased to a comfort level by utilizing the warmer refrigerant flowing through the reheat coil 34.

The economizer cycle provides the refrigerant system designer with superior control flexibility. The economizer is operable to increase the sensible and latent capacity of the evaporator 48, as disclosed above. Should increased latent capacity be desired (while the sensible capacity is preserved), the economizer cycle may be utilized in combination with the reheat coil 34.

On the other hand, if cooling is not particularly demanded but dehumidification is desired, some or all of the refrigerant may be bypassed around the condenser 26. The refrigerant reaching the reheat coil 34 will now be in a two-phase state (or even in a vapor state, if flow control device 21 is predominantly closed) and has more re-heating capacity, than if it had passed through the condenser 26. That higher heating capacity refrigerant will re-heat the air passing over the reheat coil 34 to a higher temperature, than if that same refrigerant had passed through the condenser 26. Once again, the economizer cycle can be utilized to improve the system performance and to satisfy a wider spectrum of latent and sensibly capacity demands, if desired. As discussed above, the bypass flow control device 30 can be controlled to provide variable performance characteristics over a range of sensible heat ratios. Again, this system operation flexibility provides the designer of the refrigerant system 20 with additional control options, to satisfy a wider range of temperature and humidity levels. Obviously, the economizer circuit tap point 39 can be located downstream of the economizer heat exchanger 44 but upstream of the main expansion device 46 or downstream of the return point 38 of the reheat circuit but upstream of the economizer heat exchanger 44.

Figure 1B:
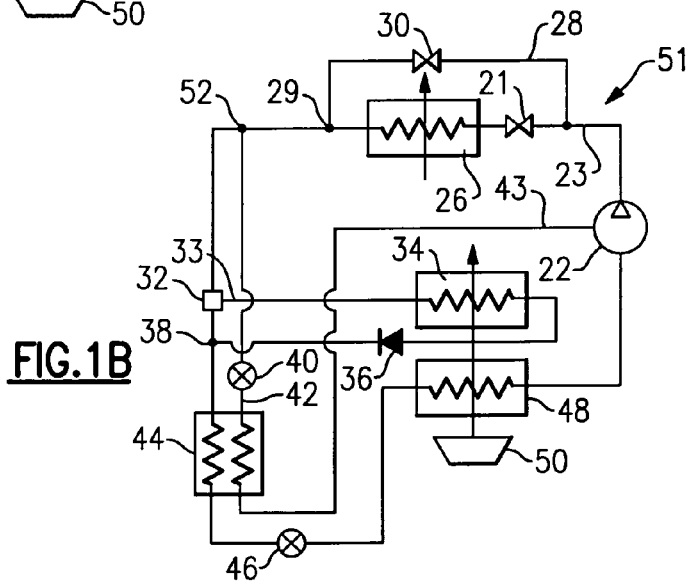
FIG. 1B is a second schematic of a refrigerant system according to this invention.

FIG. 1B shows a refrigerant system 51 that operates and performs similar functions to the refrigerant system 20 illustrated in FIG. 1A. In other words, the economizer heat exchanger 42 and the reheat coil 34 are arranged sequentially, with the reheat coil located upstream of the economizer heat exchanger. However, the tap 52 for the tapped refrigerant passing through the economizer heat exchanger 44 is selected from a location upstream of the three-way valve 32, but downstream of the return point 29 of the bypass line 28. This tap point 52 can be also located downstream of the three-way valve 32 but upstream of the return point 38 of the reheat circuit.

Figure 1C:
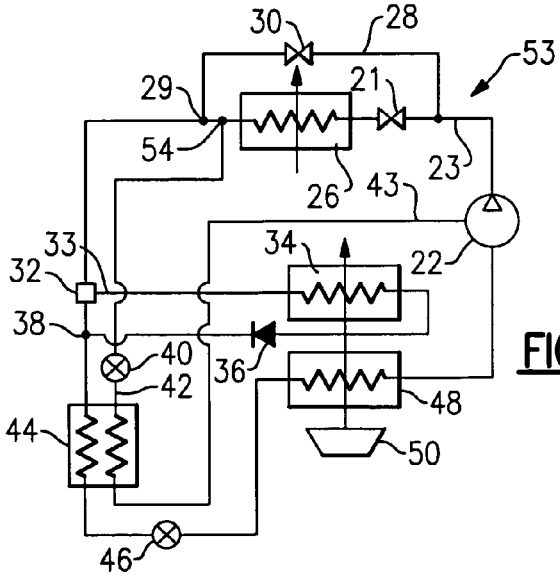
FIG. 1C is a third schematic of a refrigerant system according to this invention.

FIG. 1C shows a refrigerant system 53 wherein the economizer tap 54 is upstream of both the three-way valve 32, and the return point 29 of the bypass line 28. The location of the economizer tap 39, 52, and 54 can be selected based upon the application of a particular refrigerant system. By selecting the particular position, a particular thermodynamic state of the refrigerant passing into the tap line can be achieved. Lastly, the three-way valve 32 can be either a conventional or a regulating flow control device. Also, a pair of conventional or regulating valves can be utilized instead.

Figure 2A:
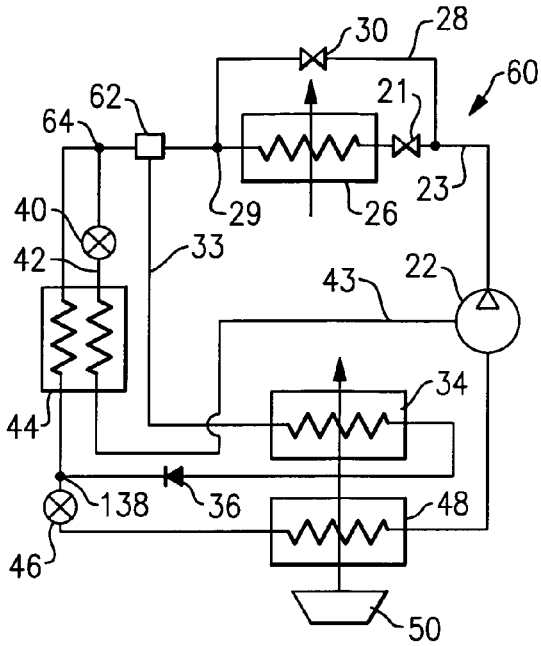
FIG. 2A is a fourth schematic of a refrigerant system according to this invention.

FIG. 2A shows a refrigerant cycle 60, wherein the three-way valve 62 for the reheat coil 34 is located downstream of the return point 29 of the condenser bypass line 28 and upstream of the economizer tap 64. As shown, the reheat coil returns refrigerant to a point 138 that is downstream of the economizer heat exchanger 44. Notably, in the FIGS. 1A–1C schematics, the return point 38 is upstream of the economizer heat exchanger 44. In this sense, the economizer heat exchanger 42 and the reheat coil 34 are in a parallel arrangement now and if both reheat and economizer circuits are in operation, the refrigerant flow has to split between these two branches. As discussed before, the economizer tap point 64 can be located anywhere downstream of the economizer heat exchanger 44 but upstream of the expansion device 46. Once again, selectively operating the economizer heat exchanger 44, in conjunction or independently from the reheat coil 34, provides advantages analogous to those mentioned above. Also, system reliability can be enhanced through a precise external heat load satisfaction and consequent reduction of the start-stop cycles.

Figure 2B:
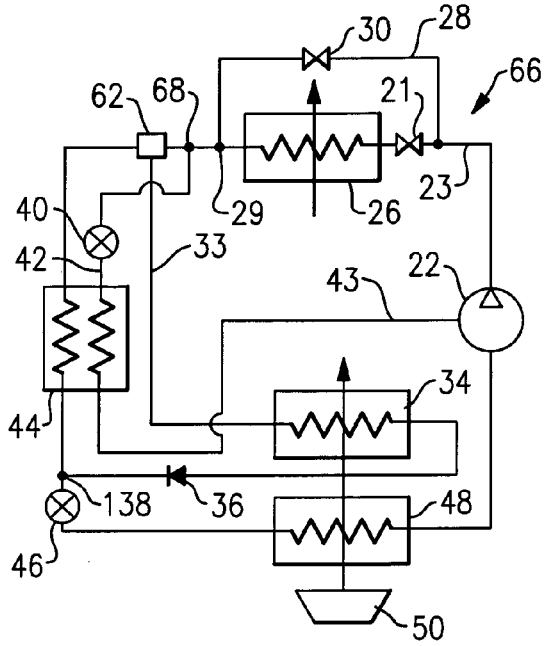
FIG. 2B is a fifth schematic of a refrigerant system according to this invention.

FIG. 2B is similar to FIG. 2A, however, the tap point 68 for the tapped line 42 is located downstream of the return point 29 of the condenser bypass line 28, but upstream of the three-way valve 62. Again, the particular location can be selected to provide enhanced control of the refrigerant system. Obviously, a less desirable location downstream of the condenser 22 and upstream of the return point 29 of the condenser bypass line 28 can be selected as well.

Figure 3A:
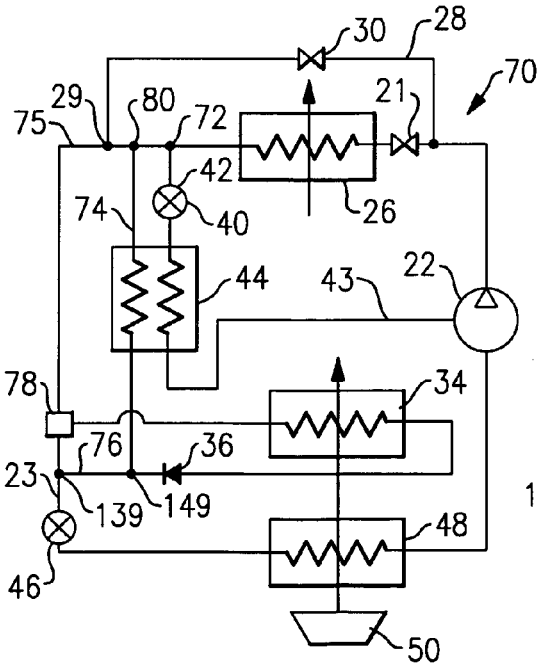
FIG. 3A is a sixth schematic of a refrigerant system according to this invention.

FIG. 3A shows a refrigerant system 70, wherein a tap point 72 for directing refrigerant into the tap line 42 is positioned upstream of the return point 29 for the condenser bypass line 28. The main refrigerant flow is either passed at point 80 into line 74 passing through the economizer heat exchanger 44, or into line 75 leading to a three-way valve 78. If the three-way valve 78 is a regulating flow control device, then the refrigerant could simultaneously flow through both aforementioned paths. From the three-way valve 78, refrigerant may be passed through the reheat coil 34, and back through a line 76 to a return point 139, or alternatively, directly to the main expansion device 46. As can be appreciated, the line 74 passing through the economizer heat exchanger 44 rejoins line 76 at point 149 and then at point 139 rejoins main flow line 23. Obviously, the point 149 can be located on line 76 or on line 23 between the three-way valve 78 and the main expansion device 46. In this sense, the reheat and economizer branch are once again in a parallel arrangement. Obviously, the tap point 72 can be located anywhere between the condenser 26 and the main expansion device 46. Similarly, the abovementioned benefits can be obtained for this system configuration as well.

Figure 3B:
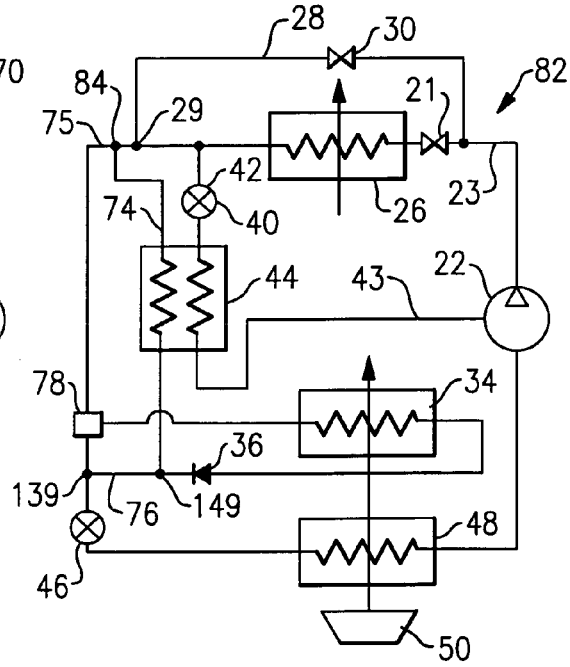
FIG. 3B is a seventh schematic of a refrigerant system according to this invention.

FIG. 3B exhibits a refrigerant system 82 that is similar to the FIG. 3A embodiment, however, the location of the tap 84 for the main flow passing through the economizer heat exchanger 44 is downstream of the point 29 for the condenser bypass line 28. Again, a refrigerant system designer can control the amount of refrigerant passing through the bypass line 28, and through the condenser 26 such that the refrigerant reaching the economizer loop is of a desired thermodynamic state, thus providing a wider range for the system performance control.

Figure 4A:
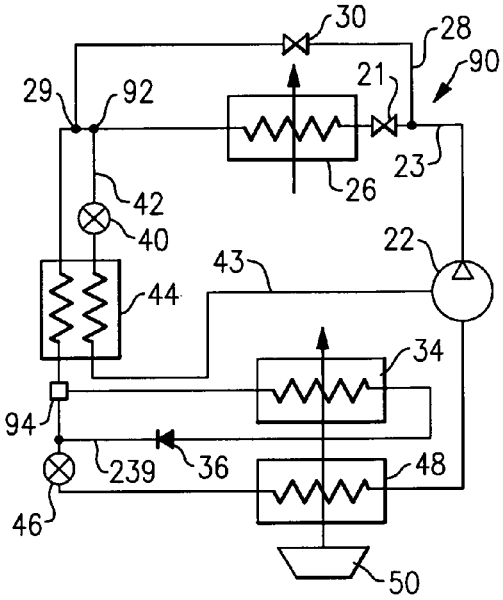
FIG. 4A is an eighth schematic of a refrigerant system according to this invention.

Refrigerant system 90 is illustrated in FIG. 4A. Refrigerant system 90 has refrigerant passing from a tap point 92 into line 42 at a location upstream of the return point 29 of the condenser bypass line 28. The three-way valve 94 for directing refrigerant into the reheat coil 34 is located downstream of the economizer heat exchanger 44. A return line 239 for returning the refrigerant to the main line 23 from the reheat coil 34 is also downstream of the economizer heat exchanger 44, downstream of the three-way valve 94 and upstream of the main expansion device 46. In this sense, although the reheat coil 34 and economizer heat exchanger 44 are configured in a sequential arrangement, now the reheat coil is located downstream of the economizer heat exchanger. As before, the tap point 92 can be located anywhere between economizer heat exchanger 44 and main expansion device 46. Similarly, the aforementioned advantages are obtained form this system schematic as well.

Figure 4B:
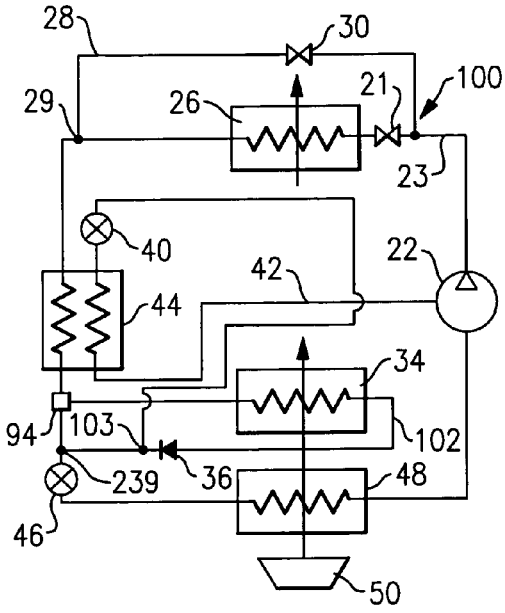
FIG. 4B is a ninth schematic of a refrigerant system according to this invention.

FIG. 4B shows a refrigerant system 100 that is similar to the FIG. 4A embodiment. However, the return line 102 from the reheat coil 34 provides the point 103 to tap refrigerant into the tap line 42. Again, a refrigerant system designer would recognize when such a schematic would be desirable to achieve flexibility in temperature and humidity control.

Figure 5A:
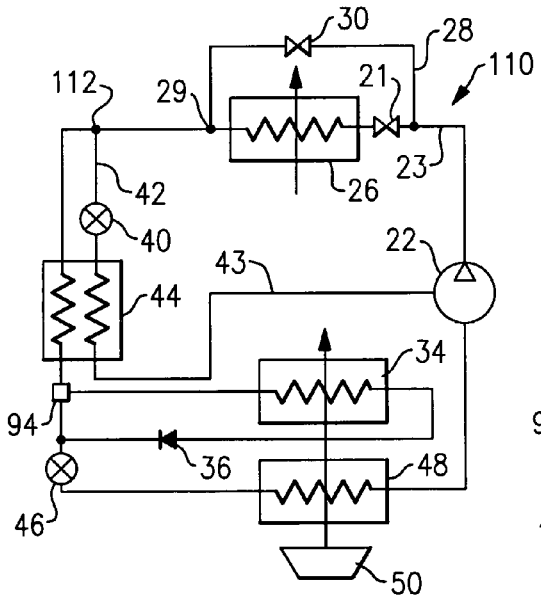
FIG. 5A is a tenth schematic of a refrigerant system according to this invention.

FIG. 5A shows a refrigerant system 110, wherein the point 112 at which refrigerant is tapped into the line 42 is located downstream of the return point 29 of the condenser bypass line 28. The FIG. 5A embodiment differs from the FIG. 4A embodiment in that the tap point is downstream of the return point 29.

Figure 5B:
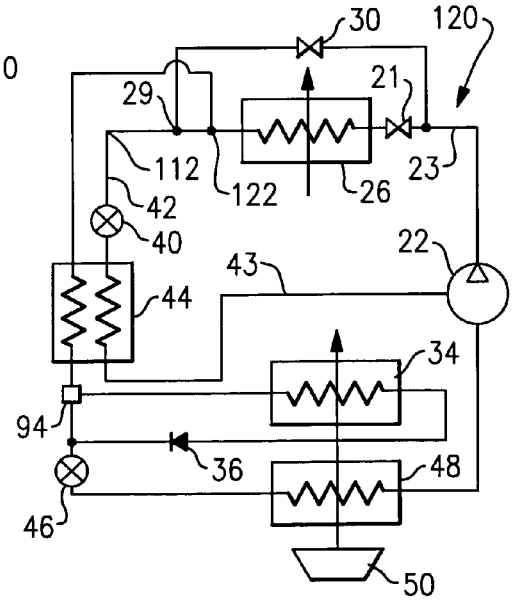
FIG. 5B is an eleventh schematic of a refrigerant system according to this invention.

FIG. 5B shows a schematic similar to the FIG. 5A schematic, in which a refrigerant system 120 has its connection point 122 for delivering a main flow of refrigerant through the economizer heat exchanger 44 located upstream of the return point 29 of the condenser bypass line 28. Again, a refrigerant system designer would recognize when such a schematic would be desirable in providing a particular degree of control over refrigerant reaching the reheat coil 34, the economizer heat exchanger 44, and the evaporator 48.

Although preferred embodiments of this invention have been disclosed, a worker of ordinary skill in the art would recognize that certain modifications would come within the scope of this invention. For that reason, the following claims should be studied to determine the true scope and content of this invention.

What is claimed is:

1. A refrigerant system comprising:

a compressor for compressing refrigerant and delivering the refrigerant into a discharge line;

a condenser downstream of said compressor for receiving refrigerant from said discharge line, and a condenser bypass line for communicating refrigerant from said discharge line around said condenser, a flow control device being positioned in said condenser bypass line, said condenser bypass line communicating back into said main refrigerant line at a junction point downstream of said condenser;

a main expansion device downstream of said junction point, and an evaporator downstream of said main expansion device, said evaporator returning refrigerant back to said compressor;

an economizer cycle incorporated into said refrigerant system, said economizer cycle including a tap line, a main economizer flow line, an economizer expansion device, and an economizer heat exchanger; and a reheat branch including a three-way valve for selectively communicating a refrigerant to a reheat coil downstream of said condenser, and an air moving device for passing air over said evaporator and at least a portion of said air over said reheat coil.

2. The refrigerant system as set forth in claim 1, wherein said three-way valve is positioned to communicate refrigerant from said main economizer flow line.

3. The refrigerant system as set forth in claim 2, wherein said three-way valve is positioned to be downstream of said economizer heat exchanger.

4. The refrigerant system as set forth in claim 3, wherein said main economizer flow line is positioned to be downstream of said return communication point of said condenser bypass line.

5. The refrigerant system as set forth in claim 3, wherein said main economizer flow line is positioned at a location intermediate of said condenser and said return communication point of said condenser bypass line.

6. The refrigerant system as set forth in claim 2, wherein said three-way valve is positioned to be upstream of said economizer heat exchanger.

7. The refrigerant system as set forth in claim 1, wherein said tap line for said economizer cycle is positioned to be downstream of said return communication point of said condenser bypass line.

8. The refrigerant system as set forth in claim 7, wherein said tap line is positioned to be in a return line from said reheat coil, returning refrigerant from said reheat coil back to said main refrigerant line.

9. The refrigerant system as set forth in claim 1, wherein said tap line communicates refrigerant from a location intermediate of said condenser and said return communication point of said condenser bypass line.

10. The refrigerant system as set forth in claim 1, wherein said economizer heat exchanger and said reheat coil are positioned to be in a parallel flow relationship with each other.

11. The refrigerant system as set forth in claim 1, wherein said economizer heat exchanger and said reheat coil are positioned to be in a sequential flow relationship with each other.

12. The refrigerant system as set forth in claim 11, wherein said reheat coil is positioned to be upstream of said economizer heat exchanger.

13. The refrigerant system as set forth in claim 11, wherein said reheat coil is positioned to be downstream of said economizer heat exchanger.

14. A method of operating a refrigerant system comprising the steps of:

(1) providing a compressor, a condenser downstream of said compressor, a condenser bypass line for communicating refrigerant from a discharge line of said compressor around said condenser, an economizer heat exchanger and a reheat coil; and (2) operating said refrigerant system to cool a second fluid, and selectively bypassing refrigerant around said condenser when less cooling is desirable, selectively routing refrigerant to said economizer heat exchanger, and selectively routing refrigerant to said reheat coil when greater dehumidification is desired, to provide a wide spectrum of control over said refrigerant system.

15. The method of claim 14, wherein said reheat coil and said economizer are positioned to be in sequential relationship with each other.

16. The method of claim 15, wherein said reheat coil is positioned upstream of said economizer heat exchanger.

17. A method of operating a refrigerant system comprising the steps of:

(1) providing a compressor, a condenser downstream of said compressor, a condenser bypass line for communicating refrigerant from a discharge line of said compressor around said condenser, an economizer heat exchanger and a reheat coil, said reheat coil and said economizer are positioned to be in sequential relationship with each other;

(2) operating said refrigerant system by selectively bypassing refrigerant around said condenser, selectively routing refrigerant to said economizer heat exchanger, and selectively routing refrigerant to said reheat coil to provide a wide spectrum of control over said refrigerant system; and said reheat coil is positioned downstream of said economizer heat exchanger.

18. The method of claim 14, wherein said reheat coil and said economizer heat exchanger are positioned in parallel relationship with each other.

19. The method of claim 14, wherein said second fluid is air passing over an evaporator and into an environment to be conditioned.

20. The method of claim 14, wherein refrigerant is selectively routed to said economizer heat exchanger when a greater amount of cooling is desirable.

* * * * *